US006251027B1

(12) United States Patent
Buchanan

(10) Patent No.: US 6,251,027 B1
(45) **Date of Patent: *Jun. 26, 2001**

(54) GOLF PUTTER CLUB

(76) Inventor: Douglas Boyd Buchanan, The Oaks, Corely Nr Ludlow, Shropshire SY8 3AW (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/151,449

(22) Filed: Sep. 11, 1998

(30) Foreign Application Priority Data

Sep. 24, 1997 (GB) ..... 9720192
Nov. 25, 1997 (GB) ..... 9724734

(51) Int. Cl.[7] ..... A63B 53/14; A63B 53/02
(52) U.S. Cl. ..... 473/300; 473/313; 473/316
(58) Field of Search ..... 473/313, 315, 473/340, 341, 300, 568, 549, 316, 317, 318, 319, 320, 321, 322, 282, 289, 292, 332, 305–312, 314

(56) References Cited

U.S. PATENT DOCUMENTS

| | | | | |
|---|---|---|---|---|
| 3,042,405 | * | 7/1962 | Solheim | 473/313 |
| 3,214,170 | | 10/1965 | Warnock . | |
| 5,026,062 | * | 6/1991 | Freeberg | 473/238 |
| 5,328,174 | | 7/1994 | Reeder . | |
| 5,362,046 | * | 11/1994 | Sims . | |
| 5,545,094 | | 8/1996 | Hsu . | |
| 5,547,189 | * | 8/1996 | Billings | 473/313 |
| 5,569,098 | | 10/1996 | Klein . | |
| 5,571,050 | * | 11/1996 | Huang . | |
| 5,573,468 | | 11/1996 | Baumann . | |
| 5,653,644 | | 8/1997 | Jaeckel . | |
| 5,690,566 | * | 11/1997 | Bracho | 473/300 |

FOREIGN PATENT DOCUMENTS

| | | |
|---|---|---|
| 2 202 319 | 9/1988 | (GB) . |
| WO 87/04634 | 8/1987 | (WO) . |
| WO96/02301A2 | 2/1996 | (WO) . |
| WO 98/07476 | 2/1998 | (WO) . |

OTHER PUBLICATIONS

Wilson Fat Shaft Staff Brochure, 1996 Wilson Sporting Goods Co.

* cited by examiner

*Primary Examiner*—Sebastiano Passaniti
(74) *Attorney, Agent, or Firm*—Liniak, Berenato, Longacre & White, LLC

(57) ABSTRACT

A golf putter is provided. The putter is made of a substantially large (between 25 and 45 mm diameter) parallel thin walled shaft wherein part of the bare shaft forms the grip. A protruding curved end cap forms part of the grip to assist in consistency of positioning the hands when taking a grip of the putter. A thin walled end plate closes off the shaft to the putter head all being designed to maximize "feel" when stroking the ball.

14 Claims, 2 Drawing Sheets

GOLF PUTTER CLUB

BACKGROUND AND SUMMARY OF THE INVENTION

This invention relates to a golf putter club.

The game of golf has been played for at least five hundred years. Early clubs were made entirely of wood. Gradually the materials used in clubs changed. Metal was used for heads, stainless steel, titanium and composites used for shafts. Leather spiral bound grips gave way to molded rubber and man made materials. The overall shape, however, did not change i.e. a hitting head and a small diameter tapering shaft.

All clubs except the putter hit the ball extremely hard, so a certain amount of shaft flex is desirable, except in the case of the putter. In putting, which is of a gentle nature, feel is crucial.

In my United Kingdom patent applications specification No. 9720192.5 I disclosed a golf putter designed to maximize feel during the putting stroke. The present invention is a further definition of the invention disclosed in my UK patent specification No. 9720192.5. Both UK patent applications are incorporated herein in their entireties by reference.

According to the present invention there is provided a golf putter comprising a shaft having a grip end and a head end, a putter head having a striking face, connected to the head end wherein the shaft is a substantially large cross-sectional dimension parallel shaft.

To this end, the invention uses a thin walled, high tensile tube of a large diameter and a T shaped club head of rectangular section material. The invention comprises of a large diameter, thin walled tube connected to the T shaped club head by means of a short transition piece. Although the invention preferably comprises a circular shaft of large cross-sectional dimension, that is, diameter, the Rules of Golf permit non-circular cross-sections for putter grips, hence oval and U-shaped cross sections are within the scope of the present invention. In the case of an oval shaft the substantially large cross-sectional dimension would be the major diameter and in the case of a U-shaped section it would be the dimension between the flat surface and the radiused end.

Other objects, advantages and novel features of the present invention will become apparent from the following detailed description of the invention when considered in conjunction with the accompanying drawings.

DESCRIPTION OF THE PREFERRED EMBODIMENTS

Figure 1:
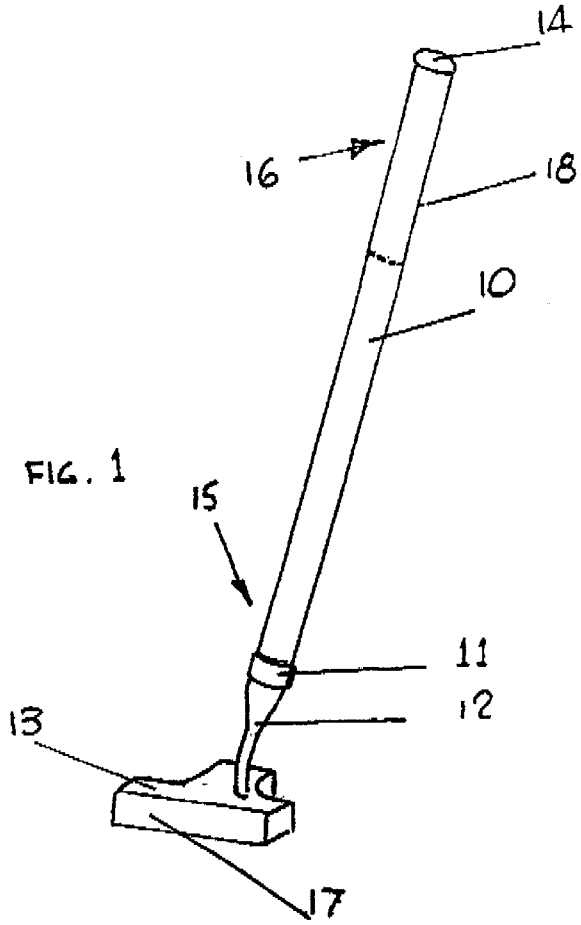
FIG. 1 is a perspective view of the putter with hollow shaft and T shaped head.
Figure 4:
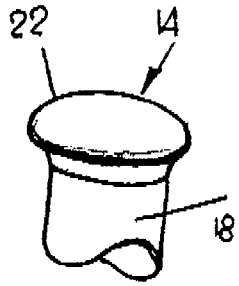
FIG. 4 is a partially fragmented elevational view of a protruding end cap in accordance with the invention.
Figure 5:
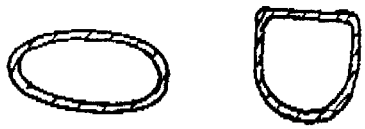
FIG. 5 shows oval and U-shaped cross sections.
Figure 2:
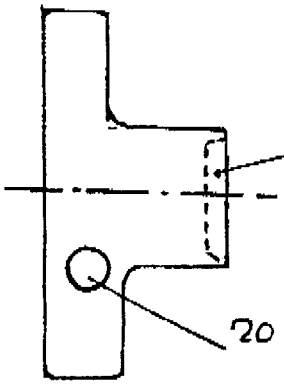
FIG. 2 is a plan view of the club head.
Figure 3:
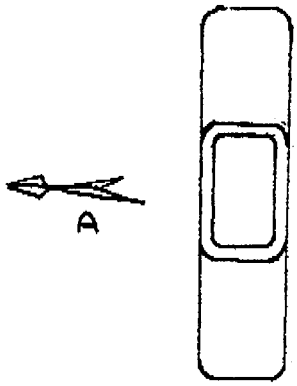
FIG. 3 is a rear elevational view of the club head of FIG. 2 as seen in the direction of arrow A which shows a rectangular head section.

Referring to the drawings, the shaft 10 is a thin walled tube of sufficiently large diameter to maximize hand feel and is made from a variety of high tensile materials such as aircraft quality aluminum, stainless steel, composite material, titanium, high performance alloy such as magnesium or lithium enhanced allow or similar suitable material to maximize feel of the contact with the ball to be transmitted through the shaft to the hands of the player.

The shaft 10 ends in a transition piece 12 which connects the shaft to the club head and is hollow to allow the transmission of contact. The hollow transition piece 12 is made of a suitable material composite, aluminum titanium, alloy or high density plastic. The transition piece is a tight push fit into the putter head 13 and into the shaft via collar 1 which is also a tight push fit. Both are positively positioned with either pin or screw. The putter head 13 is made from a lightweight alloy suitably weighted to provide a balanced feel. The top of the shaft is finished off with a slightly proud hollow end cap 14.

Shaft 10 as seen in FIG. 1 is parallel throughout its entire length and is not tapered nor stepped and comprises a head end 15 and a grip end 16 whilst putter head 13 includes a striking face 17.

Normally a portion of the grip end 16 would be fitted with a rubber leather grip. This putter grip would tend to absorb some of the vibrations coming up the shaft at impact and it is thought this is detrimental to maximizing feel. Accordingly in this invention a portion 18 of shaft 10 delineated by the dotted lines, FIG. 1, forms the grip. In other words a conventional grip, per se, is dispensed with or omitted and the bare shaft is used as the grip. Accordingly in one sense it could be said a non-slip, non-shock absorbing grip is provided. It has been found that a circular carbon fibre shaft of substantially large cross-sectional dimension, that is, a diameter of between 25 and 45 mm, preferably 31 mm with a thin wall thickness of between 0.75 and 1 mm is best used in the practice of the invention.

Protruding end cap 14 exceeds the diameter of shaft 10 by about 1.00 to 3.00 mm per side and has a curvilinear surface 22. The curved surface 22 is designed to fit snugly into the heel of the hand at the base of the thumb of the user's hand. This is useful in that it assists in maintaining consistency of positioning of the hands when taking grip of the putter. Also the use of a substantially larger than normal diameter shaft will assist in stabilizing the hands and fingers when gripping the putter.

Figure 6:
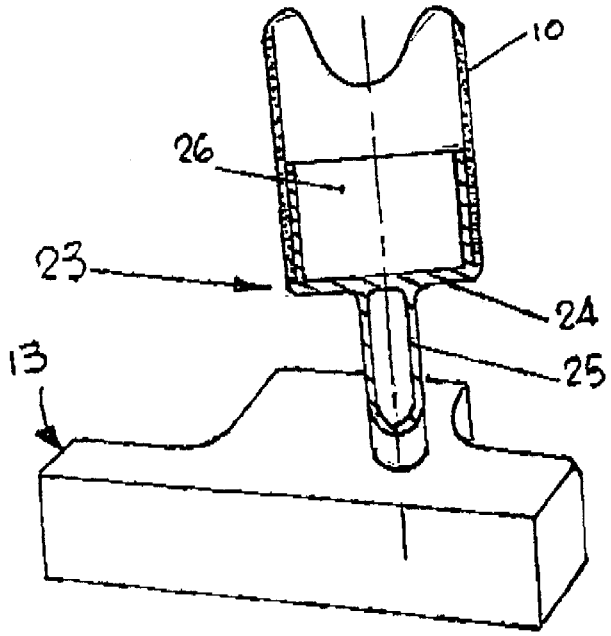
FIG. 6 is a part sectional view of a further embodiment of the present invention.

In FIG. 6 there is illustrated a connection 23 between the putter head 13 and shaft 10 which is an important part of the present invention. Connection 23 includes a thin walled end plate 24 of between 0.75 mm and 1.5 mm thickness which bridges across and in this case closes off the end of shaft 10.

Figure 7:
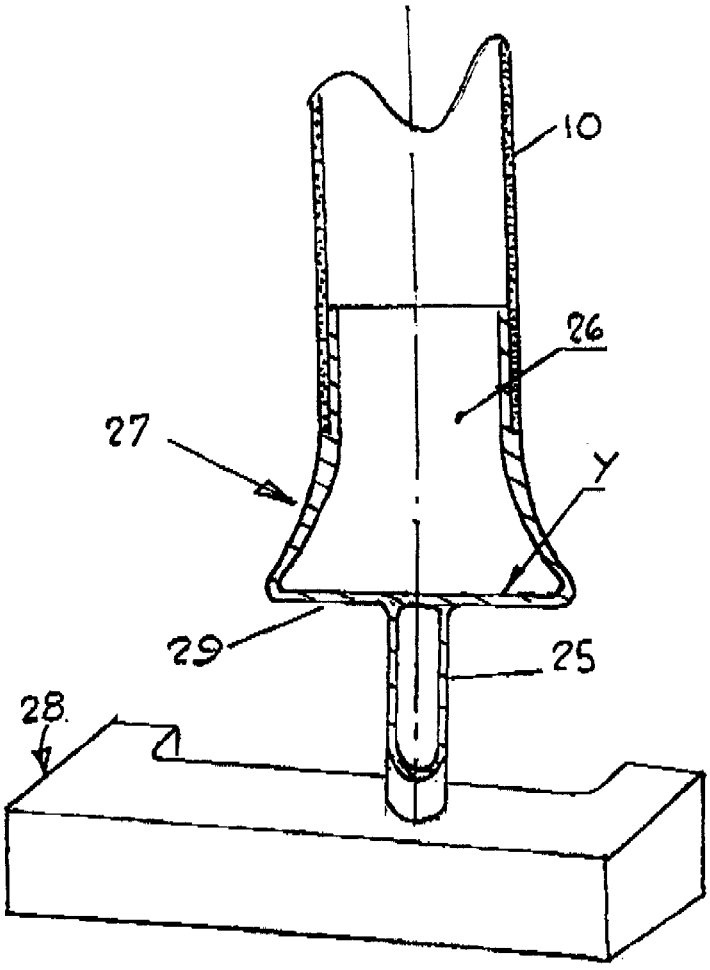
FIG. 7 is a part sectional view of an alternative embodiment to the embodiment shown in FIG. 6.

Depending from end plate 24 is a thin walled hollow hosel member 25 which attaches to putter head 13 and arising from plate 24 is an upper projecting portion 26 which attaches to the inside of shaft 10. Connection 23 may be in the form of a lightweight metal alloy casting or any of the materials mentioned with respect to transition piece 12. The thin walled end plate 24, can, to some extent provide a "drumskin" effect, that is, form a diaphragm which will tend to enhance transmission of feel from putter head 13 to shaft 10. FIG. 7 illustrates how connection 27 between shaft 10 and head 28 may be constructed to provide a thin walled end plate 29, enlarged to be greater then the diameter of shaft 10 to increase the "drumskin" effect. In this example, connection 27 is flared thus giving a bell-mouthed effect which increases the area of end plate 29 over the area corresponding to the area provided by the grip end shaft diameter shown in FIG. 6. In the example of FIG. 7, connection 27 forms a continuation of shaft 10.

In order to locate the transition piece there is a deep blind hole location 20, the position of which can be located to suit the techniques of the individual player. To meet the requirements of the Rules of Golf as laid down by the Royal and Ancient Golf Club of St. Andrews and the United States Golf Association, there is a recess 21 of sufficient depth rendering the rear face of the head unsuitable for play since to be legal under the above Rules a golf club may have one striking face only.

What is claimed is:

1. A golf putter comprising:

a shaft having a grip end and a head end, a putter head having a striking face connected to the head end, wherein the shaft is a substantially large cross-sectional dimension, thin-walled tubular parallel shaft, and wherein a portion of the shaft at the grip end comprises the putter grip, and a connection member connecting the shaft and the putter head, said connection member including a thin walled, hollow hosel member.

2. A golf putter according to claim 1, wherein the grip end includes a protruding end cap and wherein the end cap is curvilinear to fit the heel of a hand at the base of a thumb of a user to provide consistency in positioning the hand when taking a grip on the putter.

3. A golf putter according to claim 2, wherein the end cap is hollow.

4. A golf putter comprising:

a shaft having a grip end and a head end, a putter head having a striking face connected to the head end, wherein the shaft is a substantially large cross-sectional dimension, thin-walled tubular parallel shaft, and wherein a portion of the shaft at the grip end comprises the putter grip, and a connection member connecting the shaft and the putter head, said connection member including a thin walled, hollow hosel member, wherein the connection member includes a thin walled plate member closing off the head end of the tubular shaft.

5. A golf putter according to claim 4, wherein the shaft has a circular cross section and a diameter of between 25 and 45 mm.

6. A golf putter according to claim 5, wherein the diameter is 31 mm.

7. A golf putter according to claim 4, wherein a wall thickness of the shaft is between 0.75 and 1.00 mm.

8. A golf putter as claimed in claim 2, wherein the shaft has an oval or U-shaped cross-section.

9. A golf putter according to claim 4, and further comprising a projecting portion projecting from a side of the plate member opposite to the hollow hosel member to connect to the shaft.

10. A golf putter according to claim 9, wherein the plate member, the hollow hosel member and the projecting portion are part of a lightweight casting.

11. A golf putter according to claim 10, wherein the connection member is enlarged at one end thereof to accommodate an end plate greater in area than an area of the shaft at the grip end.

12. A golf putter according to claim 11, wherein the one end of the connection member is flared.

13. A golf putter comprising:

a shaft having a grip end and a head end, a putter head having a striking face connected to the head end, wherein the shaft is a substantially large cross-sectional dimension, thin-walled tubular parallel shaft, and wherein a portion of the shaft at the grip end forms the putter grip, and a connection member connecting the head and the portion of the shaft at the shaft head end, the connection member being a transition piece in the form of a hollow hosel member having a substantially large cross-sectional dimension at one end to connect to the shaft and a smaller dimension at the other end to connect to the putter head.

14. A golf putter according to claim 13, wherein the transition piece is a tapered transition piece.

* * * * *